US005464095A

United States Patent [19]

Lacayo

[11] Patent Number: 5,464,095

[45] Date of Patent: Nov. 7, 1995

[54] NEWSPAPER AND MAGAZINE PROTECTIVE CARRYING POUCH

[76] Inventor: Rodolfo W. Lacayo, 5841 Almond Valley Way, Quartz Hill, Calif. 93536

[21] Appl. No.: 248,549

[22] Filed: May 24, 1994

Related U.S. Application Data

[63] Continuation-in-part of Ser. No. 832,329, Feb. 7, 1992, abandoned.

[51] Int. Cl.[6] ..... B65D 65/08; A45C 3/02

[52] U.S. Cl. ..... 206/449; 190/901; 190/902; 294/138; 294/150; 206/424

[58] Field of Search ..... 190/900, 901, 190/902, 903; 150/901; 294/138, 150, 152; 229/DIG. 3; 206/449, 557, 424

[56] References Cited

U.S. PATENT DOCUMENTS

| | | | |
|---|---|---|---|
| 308,418 | 11/1884 | Lockwood | 190/902 |
| 473,540 | 4/1892 | Wheeler | 190/901 |
| 841,902 | 1/1907 | Shumard | 190/901 |
| 1,373,136 | 3/1921 | Kranz | 190/901 |
| 3,041,638 | 7/1962 | Vico | 190/901 |
| 4,671,393 | 6/1987 | Rainey | 190/901 |
| 4,890,873 | 1/1990 | Prada et al. | 294/138 X |

FOREIGN PATENT DOCUMENTS

| | | | |
|---|---|---|---|
| 335592 | 10/1989 | European Pat. Off. | 190/901 |
| 373318 | 6/1990 | European Pat. Off. | 190/901 |
| 655481 | 4/1986 | Switzerland | 150/901 |

*Primary Examiner*—Jimmy G. Foster
*Attorney, Agent, or Firm*—John P. Halvonik

[57] ABSTRACT

The invention is a carrying pouch that is shaped and sized to function as a protective pouch, specifically for newspapers, magazines, and other similar articles. The pouch is open at both ends and may be of cardboard, paper, leather or synthetic materials such as Naugahyde, polyvinyl chloride or other plastics. Optional versions include: the use of a spine made of a synthetic sheet with scoring to facilitate the folding of the pouch; interior rollers to facilitate the removal of the newspaper and padded walls for comfort. A securing strap of leather, rubber, elastic or synthetic material may be attached to the cutside of the pouch for additional securing. Advertising indicia, appropriate for the channels of trade that the pouch may be used in, may be displayed on the sides of the pouch.

8 Claims, 4 Drawing Sheets

NEWSPAPER AND MAGAZINE PROTECTIVE CARRYING POUCH

This is a continuation-in-part of application Ser. No. 07/832,329, filed Feb. 7, 1992, now abandoned.

BACKGROUND OF THE INVENTION

1. Field of the Invention

The invention relates generally to the field of bookbags, briefcases, and other similar protective cases. More specifically, the invention is a specially sized and shaped pouch for carrying magazines, newspapers, and similar-sized items. The pouch protects the newspaper from the elements while protecting the consumer from the newspaper ink. Additionally, the pouch provides an additional medium for advertising investment. Methods that involve, for instance, placing the newspaper within a brief case prevent the user from quick and easy access to the newspaper while traveling on public transportation systems.

It is thought that the pouch may find utility by being sold in connection with newspapers, magazines, etc. that are typically distributed near commuter transportation centers. Mass transportation travelers have need for the day's news and a device that protects those items from the elements would come in handy. Advertising indicia may be placed on the sides of the pouch. The use of padded walls in the pouch provides a pillow for the subway commuter. While construction materials may vary in accordance with the intended market, cheaper materials may be used where the pouches are distributed directly at newspaper stands or outlets along commuter routes.

2. Prior Art

While there are brief cases and other similar items, no carrying case that applicant is aware of is adapted for carrying newspapers, magazines and similarly sized articles. Nor is it believed that there are any such carrying bags that have padded material for the device doubling as a pillow.

SUMMARY OF THE INVENTION

A carrying pouch open-ended on both sides and made of leather, paper, cardboard, plastic or similar materials sized to enclose a magazine or newspaper for protection from the elements. Scoring lines running parallel to the sides of the case enable the user to size the pouch to fit the width of the newspaper held therein. The device may also use a reclosable strap that encircles the carrying pouch portion. Other options include a padded side wall for comfort and/or interior rollers to facilitate the removal of the newspaper.

It is an objective of the invention to provide a weather-resistant pouch for holding magazines, newspapers and other such articles.

Another objective is to provide a unique advertising medium for attracting national advertisers to thus generate additional revenue for the newspaper industry.

Yet another objective is to provide a pouch to protect consumers from ink from newspapers and magazines transferring onto clothing or hands during transportation.

Still another objective is to provide a means to encourage the recycling of newspapers.

Yet another objective of the invention is to provide a newspaper carrying pouch that may be used as a pillow for the subway commuter who may typically use the present invention.

Still another objective is to provide a newspaper carrying pouch with means to facilitate the removal of such articles from the interior of the pouch.

Other objectives will become apparent once the invention is shown and described.

DESCRIPTION OF THE PREFERRED EMBODIMENT

Figure 1:
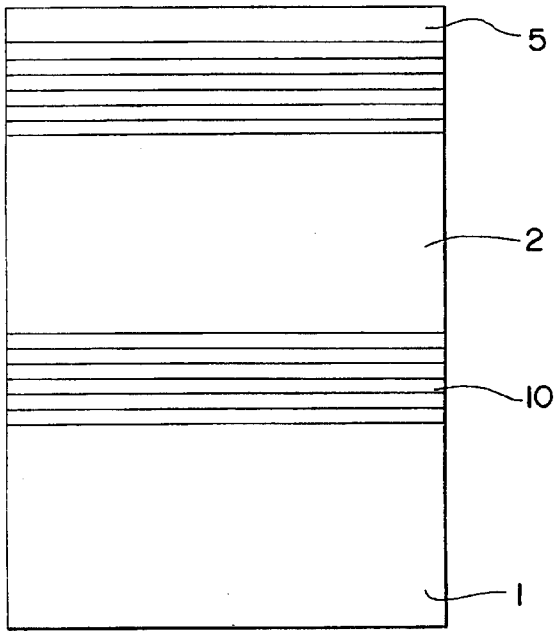
FIG. 1 Overall Construction of Pouch
Figure 2:
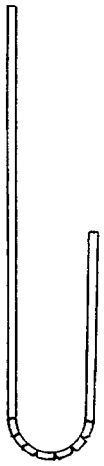
FIG. 2 Side view of Pouch
Figure 3:
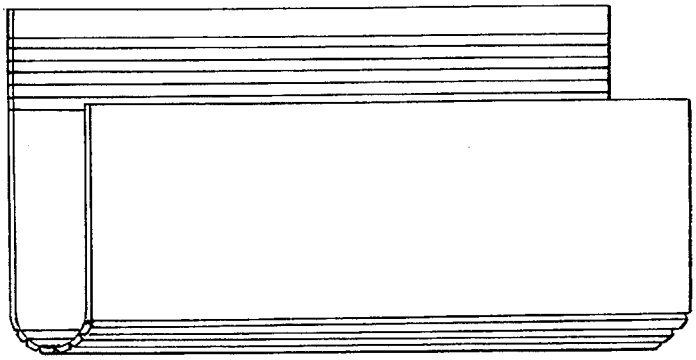
FIG. 3 Semi closed view
Figure 4:
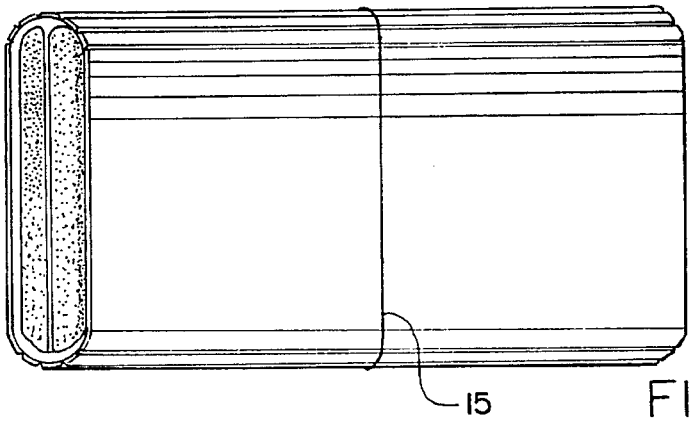
FIG. 4 Pouch with flap closed.

The newspaper carrying pouch of the present invention is shown in FIGS. 1 and 4 as a low to medium cost article. FIGS. 5–10 show the more expensive versions. The pouch is basically formed of two side walls 1 and 2 connected along one of the edges of each to form a pouch portion for containing the newspaper. Some versions of the article may have an upper flap portion 5 for further enclosing the pouch. This flap would be attached to the top edge of one of the side walls, the flap may work in connection with the strap attachment 15. One, and preferably both, ends of the pouch will be open ended to allow the newspaper or magazine to be removed for reading.

The two sets of score lines 5, 10 serve to divide the pouch into 3 separate panels. These may be designated the upper 5, middle 2 and lower 1 panels for purposes of convenience, see FIG. 1.

Figure 6:
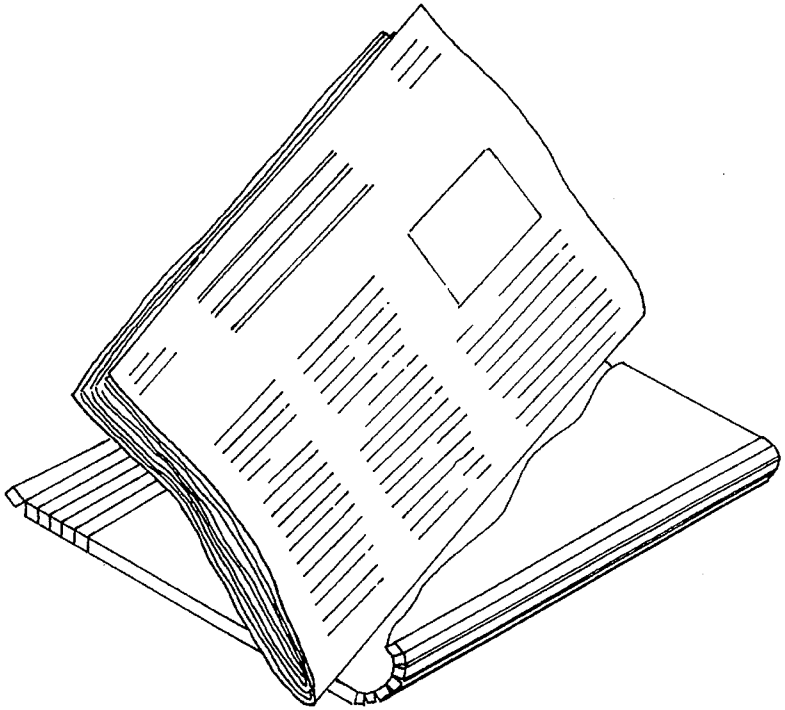
FIG. 6 Article in use as a newspaper support.

It is believed that the use of the second set of score lines enables the pouch to function as a paper support for the reader when he is e.g. on a train and ready to read the paper, see FIG. 6. The pouch is divided into three panels that can be aligned in connection with a newspaper in order to stand the newspaper in an upright position.

In this case, the upper panel serves as a support base for the newspaper. The bottom edge of the newspaper may then rest upon the biased upper edge of the top panel. The set of scoring lines near the upper panel may be slightly bent in order to help support the paper. The bottom panel may be bent forward to support the rear of the paper. This shape enables the pouch to function as a support for reading the newspaper or what have you.

The upper panel 5 or cover panel may have a portion of the upper edge 24 cut along a bias so that it forms an angle to the bottom edge and is not parallel to it. The angled upper edge would then allow the top panel to support a newspaper.

Figure 5:
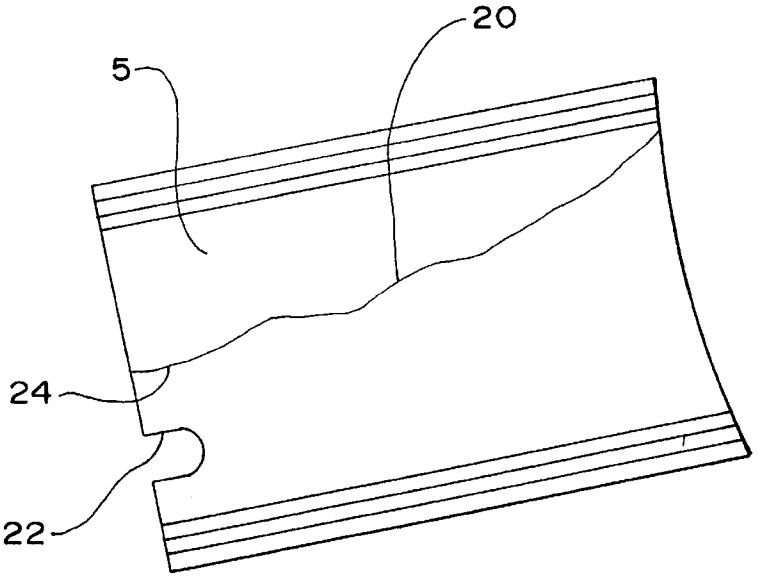
FIG. 5 Article with finger grips in folded position.

FIG. 5 shows the cover flap including the Finger grip 20 and the grab gap 22. The finger grip is a cut out portion of upper edge of the upper flap or cover flap. This cut out portion has a series of curved portions that can align with the fingers of the user to enable the user to readily remove the cover panel. The placement of the finger grip should be such that the user will be pulling at a point that is away from the VELCRO closures that may be used on the underside of the upper panel. This will keep the VELCRO from being ripped off from the cover panel as the article is opened and closed. It is thought that there may be two or three curved portions to align with two or three fingers of the user.

A closure means may be formed by a VELCRO closure piece attached to the underside of the upper panel that can attach to a corresponding piece on the (Lower) panel The use of the finger notches should provide an easy way for the user to lift up on the upper panel without applying such force to the VELCRO pieces as to tear them from their point of attachment to the panels.

The grab gap 22 is a curved notch cut out of one of the side edges of the (Lower) panel. This opening allows a portion of the newspaper etc. to be exposed and allows the user to grip the newspaper for easy removal.

It is preferred that cardboard and plastic be the preferred materials for the article. Scoring lines and/or fold lines may be used on both the cardboard and the plastic versions. A VELCRO closure may be made with mating VELCRO portions on the underside of the closure flap and on the (Lower) panel. They should be in close connection with the finger grip.

Figure 8:
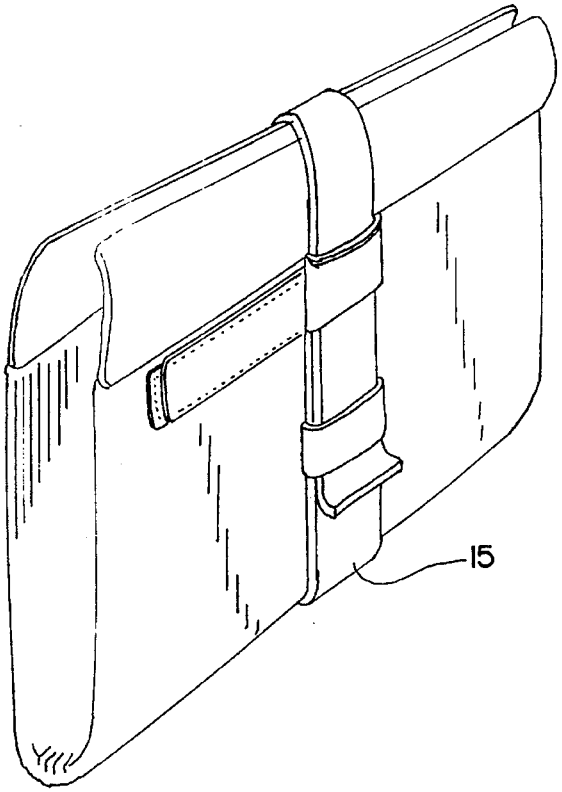
FIG. 8 Higher end pouch
Figure 9:
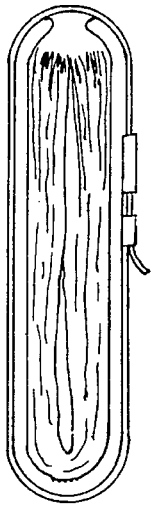
FIG. 9 Side view of High end Pouch
Figure 7:
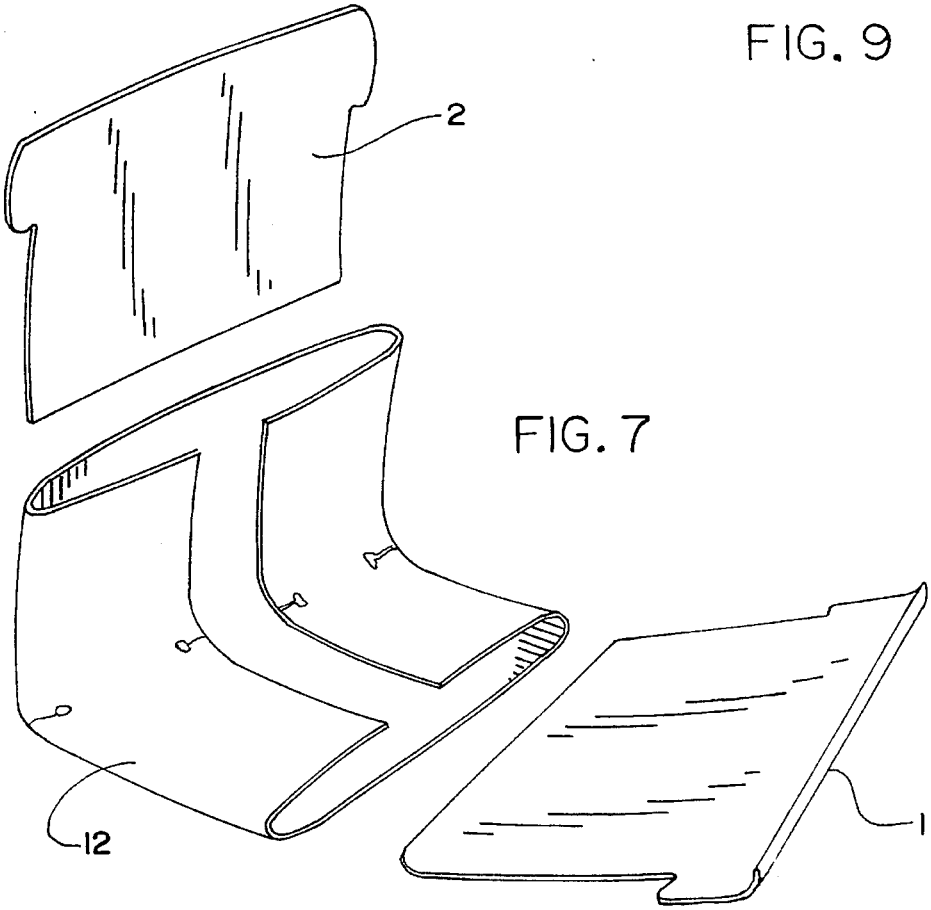
FIG. 7 Exploded view with segmented strap

Encircling the pouch may be a strap that may be secured around the newspaper inside the pouch, see e.g. FIGS. 4, 7 and 8. The strap provides a means to ensure that newspaper will remain in place inside the pouch. The strap could be like leather or neoprene in the more expensive models and could be as simple as a rubber band in the lower cost models.

Construction materials used for the side walls of the pouch may vary in accordance with the market that the pouch is directed toward. For instance, a mass produced pouch may be made inexpensively and sold in large quantities, perhaps at the distribution sites of newspapers and magazines. These lower-end items could be dispensed directly from newspaper vending machines or newsstands. Typical of such materials for low-end, mass distributed, pouches would be paper or cardboard. The preferable version of the low end model would use corrugated cardboard as the basic construction material. The typical useful life of such an item would be about 1–2 weeks and then the consumer acquires another one.

More expensive varieties of pouch (middle range price) would be constructed of polyvinyl material or other type of plastic materials. These middle range items could be dispensed directly from bookstores, news stands, and other lower profile outlets. Product life would be longer than the low end item.

Figure 11:
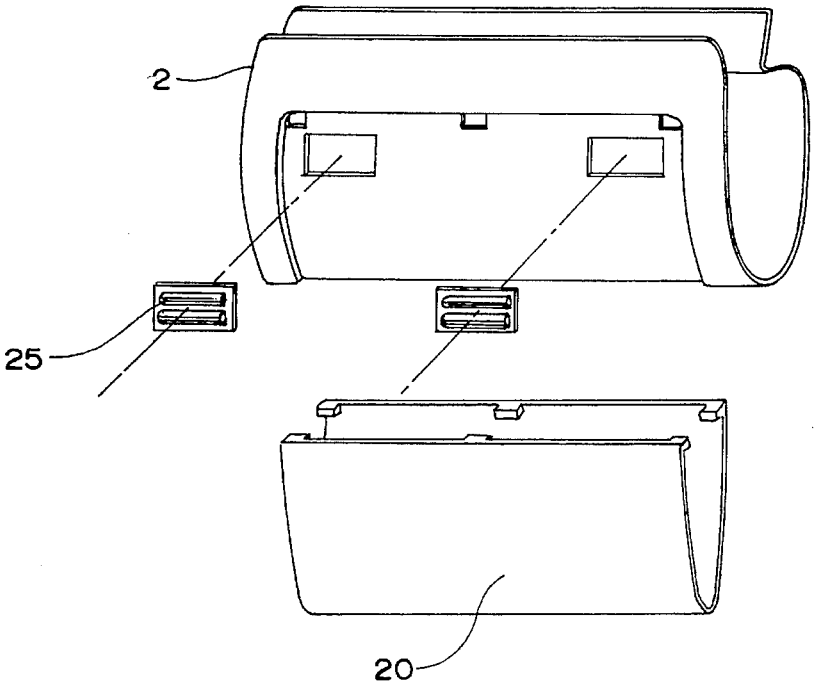
FIG. 11 Pouch with grip pads and roller

More expensive pouches may be made of leather or similar materials for more rugged construction. These higher priced pouches may be sold in higher profile outlets, shopping malls, etc. Higher end items might also have one, or both, of the side walls made of padded material 20. The use of padding enables the pouch to double as pillow for the subway rider or for added comfort when carrying the pouch under the arm. FIG. 11 illustrates a higher end version (plastic in this case) that uses a padded material made of neoprene with plastic snap-on portions to facilitate the connection of the pad with the plastic walls of this version. The padding also serves as cushioning against the side of the torso when the device is carried under the arm. Rollers 25 snap into portions of the plastic side walls.

An optional variation would include the use of rollers 25 mounted on the inside of the side walls against the newspaper in the pouch. The rollers enable one to pull out the newspaper easily from the pouch, see FIG. 11.

Scoring lines 10 may be placed in the connective portion that runs between the side walls. The scoring lines are, of course, narrow slits made in the material (be it paper, cardboard, plastic, etc.) that do not extend through the entire thickness of the connective portion. The scoring lines allow one to fold the pouch to a size that is appropriate for the width of the newspaper enclosed in the pouch. Similar scoring lines may also be used in connection with the upper flap. The preferred distance between each of the scoring lines would be about ⅜".

Figure 10:
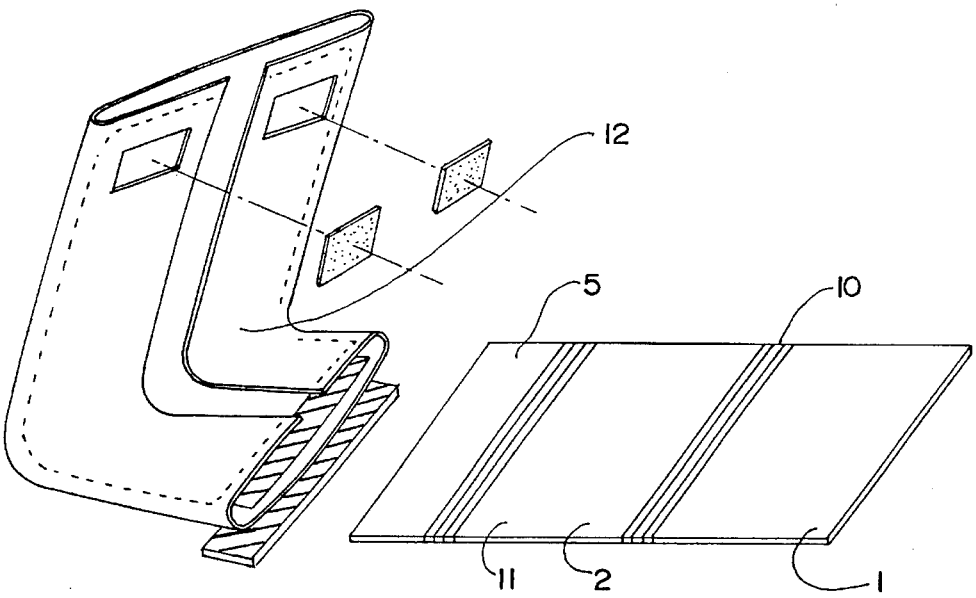
FIG. 10 Pouch with optional spine

In the leather version, scoring lines would not be used directly on the leather but rather a spine portion 11 may be used in connection with the walls as shown in FIG. 10. The spine may be a sheet portion made of polyethylene, or other semi-rigid materials, and comes with a set of scoring lines 10 running across the length of the sheet. The sheet would then be inserted into the leather shell (or wallet) 12, see e.g. FIG. 7 and 10. The hinge scoring allows one to fold the leather to the appropriate width of the newspaper by folding along one of the scoring lines. Effectively, the spine would be built similar to the overall construction shown in FIG. 1.

Preferred dimensions of the pouch would be those that are appropriate for holding newspapers and other similarly sized articles. The side walls should be about 7½" by 11½" with an adjustable width of up to about 2" at the bottom.

The side walls of the pouch may also contain advertising material that is appropriate for the mass transit context that is contemplated by the invention. In high-end versions (leather) the side walls could be made of aluminum plates 1 and 2 that may be inserted in to the leather wallet 12, see FIG. 7. FIG. 8 shows the top portions of the plates protruding above the leather wallet.

I claim:

1. A carrying pouch for transport of magazines, newspapers and similar articles comprising: a planar member made of foldable material and having top and bottom edges of about 11½" and left and right side edges of about 7½", said planar member having a first and second series of scoring lines parallel to one another and extending across said member so as to divide said member into a lower, a middle and an upper panel, a securing means in connection with one of said panels for the temporary attachment of said lower panel to said upper panel, said top edge having a biased portion so that said biased portion is not parallel to said bottom edge, said top edge having a finger grip, said finger grip comprising a set of three curved portions in said top edge.

2. The apparatus of claim 1 where said midddle panel has a notched portion in one of said side edges for the ready removal of an article placed in said apparatus.

3. The apparatus of claim 1 where said securing means comprises: said upper panel having a first hook and loop material portion and said lower panel having a second hook and loop material portion complimentary to said first hook and loop material portion for securing said upper and lower panels together.

4. The apparatus of claim 3 wherein said scoring lines are about ⅜" apart and number at least 3.

5. The apparatus of claim 4 wherein said foldable material comprises paper.

6. The apparatus of claim 4 wherein said foldable material comprises cardboard.

7. The apparatus of claim 3 wherein said foldable material comprises paper.

8. The apparatus of claim 3 wherein said foldable material comprises cardboard.

* * * * *